United States Patent [19]

Gerber et al.

[11] 4,370,631

[45] Jan. 25, 1983

[54] WAVEGUIDE SWITCH

[75] Inventors: Robert L. Gerber; Larry C. Raper, both of Ridgecrest, Calif.

[73] Assignee: The United States of America as represented by the Secretary of the Navy, Washington, D.C.

[21] Appl. No.: 227,337

[22] Filed: Jan. 22, 1981

[51] Int. Cl.[3] ..... H01P 1/10

[52] U.S. Cl. ..... 333/106; 200/153 S; 251/136; 335/4; 307/592

[58] Field of Search ..... 333/101, 105–108, 333/259; 200/153 S; 335/4, 5; 251/136

[56] References Cited

U.S. PATENT DOCUMENTS

| | | | |
|---|---|---|---|
| 2,024,823 | 12/1935 | Jones | 251/97 |
| 2,329,820 | 9/1943 | Breese | 236/68 |
| 2,399,460 | 4/1946 | Britton | 137/144 |
| 2,573,713 | 11/1951 | Kannenberg | 178/44 |
| 2,827,613 | 3/1958 | Robison et al. | 333/98 |
| 2,995,716 | 8/1961 | Schunemann et al. | 333/108 |
| 3,419,827 | 12/1968 | Webb | 333/106 |
| 3,644,852 | 2/1972 | Albee | 333/985 |
| 3,864,536 | 2/1975 | Vaughan et al. | 333/107 X |
| 4,144,774 | 3/1979 | Berlinger, Jr. | 74/435 |
| 4,185,770 | 1/1980 | Nagel | 251/136 X |

*Primary Examiner*—Paul L. Gensler

*Attorney, Agent, or Firm*—Robert F. Beers; W. Thom Skeer

[57] ABSTRACT

This invention discloses a high-speed waveguide switch for diverting energy among a plurality of waveguides. This switch is composed of a rotor, a rotor housing, biasing means, housing for the biasing means, and an electronic circuit to control the biasing means. The rotor and rotor housing are of conventional design. The biasing means is composed of two rotary solenoids mechanically linked through a geneva drive and wheel to the rotor. The electronic circuit is composed of a power supply circuit, a control circuit, and a motor circuit being the coils of the rotary solenoids. An external device such as a radar supplies a switching command signal to the control circuit. Various flip-flops are actuated based on the leading or trailing edge of the switching command signal. Signals from these flip-flops actuate switches in the power supply circuit so that a sequence of driving and braking currents is transmitted to the coils of the rotary solenoids. Upon receiving a driving current, a solenoid torques the rotor and causes it to rotate in a desired direction. Upon receiving a braking current, the other solenoid counter torques the rotor and brings it to a bounce-free stop. To return the rotor, the currents are applied to the opposite solenoids.

10 Claims, 7 Drawing Figures

WAVEGUIDE SWITCH

BACKGROUND OF THE INVENTION

1. Field of the Invention

This invention relates to waveguide switches and more particularly, to a radio frequency waveguide switch. In still greater particularity, this invention relates to a microwave waveguide switch for selectively diverting energy between one of two output ports.

2. Description of the Prior Art

Waveguide switches are activated by either a DC torque motor or a rotary solenoid. Normally, an actuating device such as either a DC torque motor or a rotary solenoid act through a mechanical linkage to move the waveguide switch.

For example, an actuating device such as a DC torque motor can torque in either rotational direction. But the DC torque motor is usually larger than the rotary solenoid, and this is a problem when space is at a minimum. Also, the DC torque motor is much slower in reaction than the rotary solenoid. Another factor, the DC torque motor is many times more expensive than a rotary solenoid.

The other actuating device is a rotary solenoid. The rotary solenoid can torque in only one direction, but the waveguide switch must be actuated in normally both directions. As a result, the rotary solenoid biases against a spring when it is actuated. If and when the switch returns to the other position, the power to the rotary solenoid is removed and the spring returns the switch to its original position when the solenoid is not actuated. This actuating device has several disadvantages. First, it is relatively slow taking over 500 milliseconds to actuate an E or F band waveguide switch. Secondly, hard mechanical stops at the end of the linkage travel cause the waveguide switch to bounce several times. Normally, a design to remove the bounce will increase the switch travel time even more and cause VSWR problems in the waveguide. Thirdly, the rotary solenoid requires the constant application of power in one of its positions and this takes a large amount of power since it has to hold torque against the spring in this direction.

SUMMARY OF THE INVENTION

The present invention has several features which overcome the disadvantages of prior waveguide switches. The waveguide switch of the present invention diverts incoming microwave energy between one of two output ports. This waveguide switch utilizes a cylindrical rotor having a diameter sufficient to allow the use of a radius bend within the rotor. The mean-length of the arc swung between the center lines of the straight waveguide sections coupled to the waveguide switch is generally three or more odd multiplies of quarter wavelengths, at the center band frequency. This radius bend construction provides for a low VSWR with an inherently broad bandwidth. The rotor is securely attached to a geneva wheel. The geneva wheel is coupled to a geneva drive having a driven gear attached to it. Two pinion drive gears are oppositely engaged to the geneva driven gear and are in a 1:1 gear ratio to the driven gear on the geneva drive. The drive pinion gears are mounted on shafts which are attached to two oppositely torquing solenoids. Each solenoid travels through a 90° angle in one operation. In operation, the waveguide switch is actuated by applying electrical energy to a driving solenoid at a given signal. Each solenoid is either a driving or a braking solenoid dependent on the rotation of the rotor. The driving solenoid causes the rotor to rotate in a desired direction. After a given delay time, energy is applied to a braking solenoid which causes the rotor to stop its rotation.

One object of this invention is a waveguide switch that diverts energy between one of two exit ports from an input port.

Another object of this invention is a waveguide switch having a switching time less than 100 milliseconds.

Still another object of this invention is a waveguide switch that is free of switch bounce.

Another object of this invention is a waveguide switch that is compact, inexpensive, and highly reliable in operation.

These and many other objects and advantages of the present invention will be readily apparent to one skilled in the art to which the invention pertains from a perusal of the claims and the following detailed description of a preferred embodiment of the invention when read in conjunction with the drawings.

DESCRIPTION OF THE PREFERRED EMBODIMENT

Figure 1:
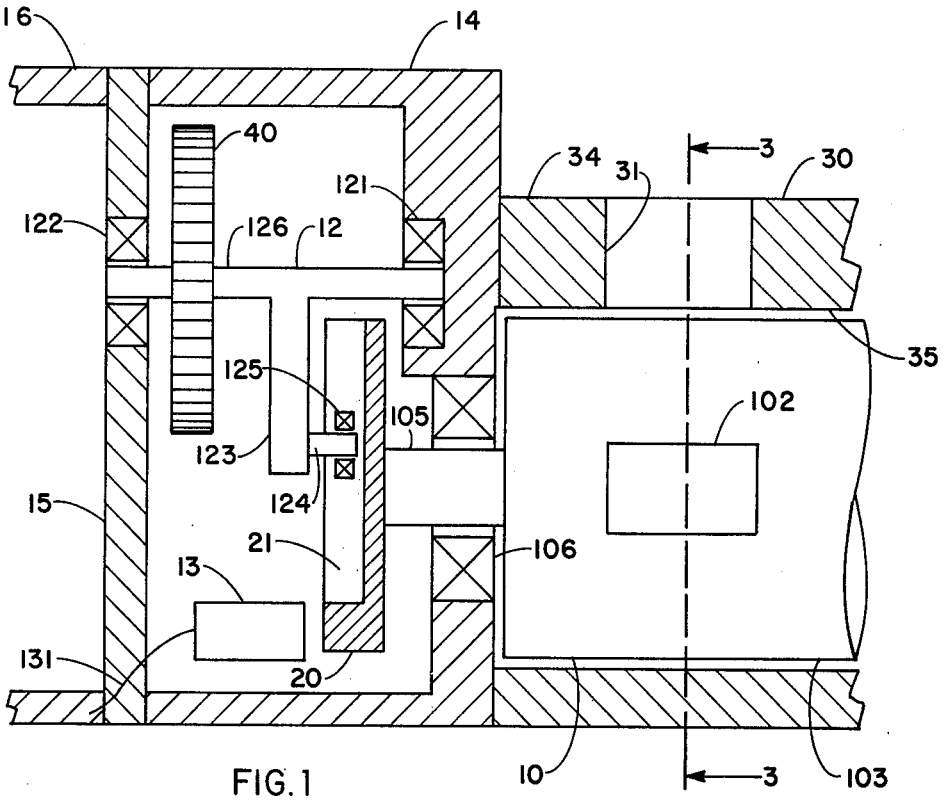
FIG. 1 is a partial sectional elevational view of the waveguide switch.

The waveguide switch of this invention is illustrated in FIG. 1. FIG. 1 illustrates part of the waveguide switch comprising a rotor 10, a rotor housing 30, a geneva drive 12, a geneva wheel 20, position sensors 13, a main housing 14, a mounting plate 15, and a cover 16.

Figure 3:
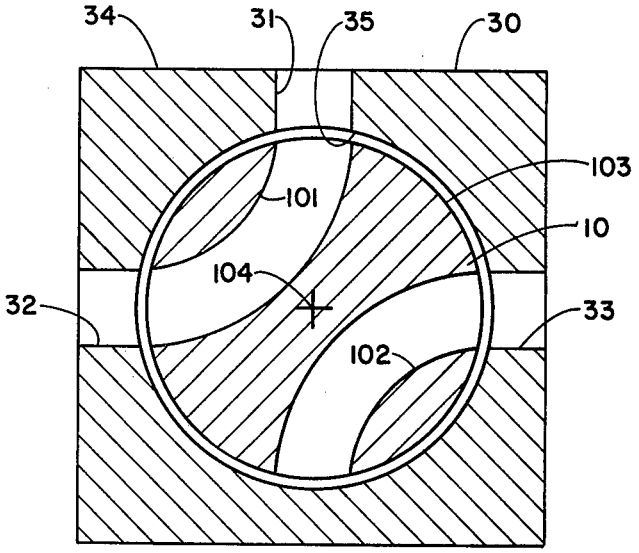
FIG. 3 is a sectional view of the cylindrical rotor and a rotor housing taken along line 3—3 of FIG. 1 showing the waveguides.

Rotor 10 and rotor housing 30 are of conventional design and are made of a highly conductive metal. FIG. 3 taken in conjunction with FIG. 1 shows in greater detail the particular design of rotor 10 and rotor housing 30. Rotor housing 30 has three rectangular waveguide ports within it. Rotor housing 30 has an input port 31, a primary output port 32, and a secondary output port 33. The particular shape of the ports in rotor housing 30 is determined by principles well known in the art based upon the particular intended application. Rotor housing surface 34 is shaped so that external waveguides can be securely attached to rotor housing 30 so that there is no discontinuity in the waveguide paths as they cross the interface between the external waveguides and rotor housing 30. Normally, the waveguides are bolted to rotor housing 30.

Rotor 10 is of a cylindrical shape and is made of a highly conductive metal. Rotor housing 30 has a cylindrical void machined within it defined by a surface 35. A rotor surface 103 and rotor housing surface 35 are closely fitting so that there is a minimum of electromagnetic discontinuity at the interface between the ports and waveguide bends 101 and 102 within rotor 10. In this particular application, rotor 10 has a diameter sufficient to allow the use of radius bends within the rotor. The meanlength of the arc swung between the center lines of the straight waveguide sections coupled to the switch is generally three or more odd multiples of quarter wavelengths, at the center band frequency. This radius bend construction provides a low VSWR with an inherently broad bandwidth. Waveguide bends 101 and 102 are located symmetrically about a rotor axis 104. Waveguide bends 101 and 102 are rectangularly shaped in the plane parallel to rotor axis 104. The walls of waveguide bends 101 and 102 are designed to coincide with the walls of input port 31 and output ports 32 and 33. The construction of cylindrical rotor 10 and rotor housing 30 is well known in the art. As illustrated in FIG. 3, rotor 10 is normally positioned so that bend 101 is aligned with input port 31 and primary output port 32. Upon receiving the switching command, biasing means acting through the mechanical linkage causes rotor 10 to rotate about axis 104 by 90° and in so doing, bend 102 is aligned with input port 31 and secondary output port 33. Upon receiving another switch command the waveguide would be rotated to the primary position illustrated in FIG. 3.

A cylindrical rotor shaft 105 is securely fixed on-center to rotor 10. Shaft 105 can be a part of rotor 10 or secured to rotor 10 by bolting or other standard techniques. Rotor shaft 105 is held securely in place by rotor shaft bearing 106 which is securely held in place in main housing 14. It is, of course, critical that the rotation of shaft 105 allows for free rotation of rotor 10 within the cylindrical void defined by surface 35 of rotor housing 30.

Figure 2:
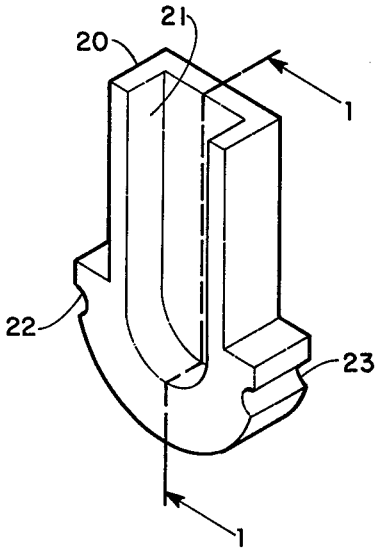
FIG. 2 is an isometric view of the geneva wheel with a sectional view shown in FIG. 1 taken along line 1—1.
Figure 4:
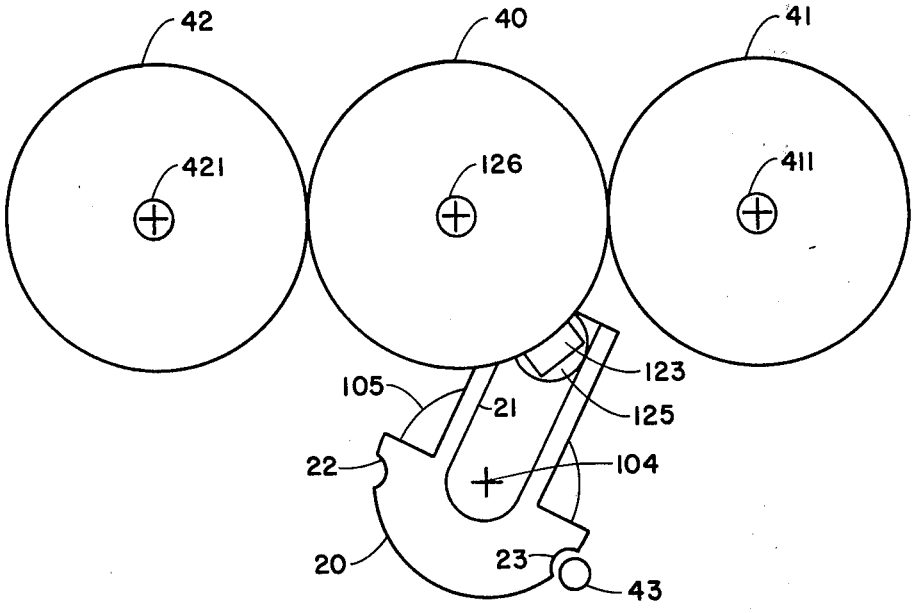
FIG. 4 is an elevational view of three pinion gears and the geneva drive and wheel.

The end of shaft 105 opposite rotor 10 is securely attached to geneva wheel 20. Geneva wheel 20 is illustrated in FIG. 2 and a sectional view along line 1—1 is illustrated in FIG. 1. Geneva wheel 20 is securely attached to rotor shaft 105 by bolting. Geneva wheel 20 has two main features. One feature is a guide channel 21 and the other feature is detent stops 22 and 23. As illustrated in FIG. 4, geneva wheel 20 is attached to rotor shaft 105 so that upon 90° rotation detent stop 22 comes to rest upon a detent mechanism 43 such as a spring biased cylindrical device. Upon a 90° clockwise rotation, detent stop 23 would come to rest upon detent mechanism 43. Guide channel 21 is essentially shaped like a rectangular slot so that a guide bearing 125 closely fits within guide channel 21. The width of guide channel 21 is approximately equal to the diameter of guide bearing 125 of FIG. 1.

Referring to FIG. 1 and FIG. 4, geneva drive 12 is illustrated. Geneva drive 12 is composed of a shaft 126, bearings 121 and 122, a lever arm 123, a guide pin 124, guide bearing 125, and a driven gear 40. Bearing 121 is securely attached to main housing 14 and bearing 122 is securely attached to mounting plate 15. These bearings can be press-fitted into cylindrical voids adapted to hold bearings of that shape. Driven gear 40 is attached to shaft 126 so that the horizontal axis of pinion gear 40 and shaft 126 align. Lever arm 124 is attached securely to shaft 126 between driven gear 40 and geneva wheel 20. Guide pin 124 is securely attached to lever arm 123 by bolting or other suitable technique. Guide bearing 125 is attached to guide pin 124 so that it movably rests within guide channel 21 of geneva wheel 20. Guide pin 124 is located a distance from the axis of shaft 126 so that upon a 90° rotation of geneva wheel 20, guide bearing 125 remains within the confines of guide channel 21 of geneva wheel 20. Guide bearing 125 fits closely within guide channel 21 so that there is a minimum of backlash as shaft 126 rotates in either a clockwise or counter-clockwise direction.

Figure 5:
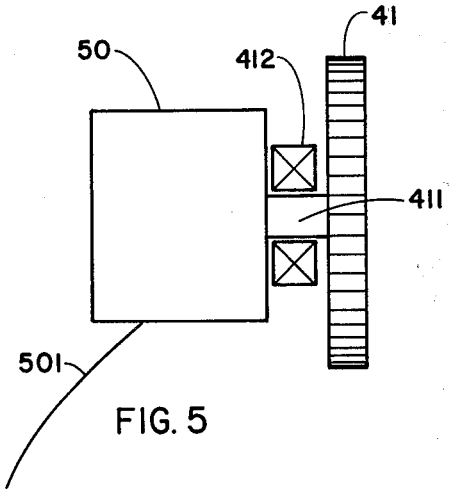
FIG. 5 is an elevational view of a rotary solenoid and a drive gear attached to the solenoid.

Driven gear 40 is in driving engagement with drive/-brake gears 41 and 42 as illustrated in FIG. 4 and FIG. 5. Drive gear 41 and 42 are formed on or affixed to output shafts 421 and 411 which are rotatable about an axis perpendicular to lever arm 123. Axes 421, 126, and 411 are located substantially in a common plane and are parallel to each other. Referring to FIG. 5, this illustrates a solenoid 50, a drive shaft bearing 412, drive output shaft 411, and drive gear 41. Drive shaft bearing412 is securely attached to mounting plate 15. A similar arrangement applies to drive/brake gear 42. An electrical connection 501 is also illustrated in FIG. 5.

Referring to FIG. 1, position sensors 13 is positioned so that it can determine when geneva wheel 20 is in a switching process. This information is transmitted on electrical connection 131 so that no radio frequency energy will be transmitted to the switch when it is changing position.

Figure 6:
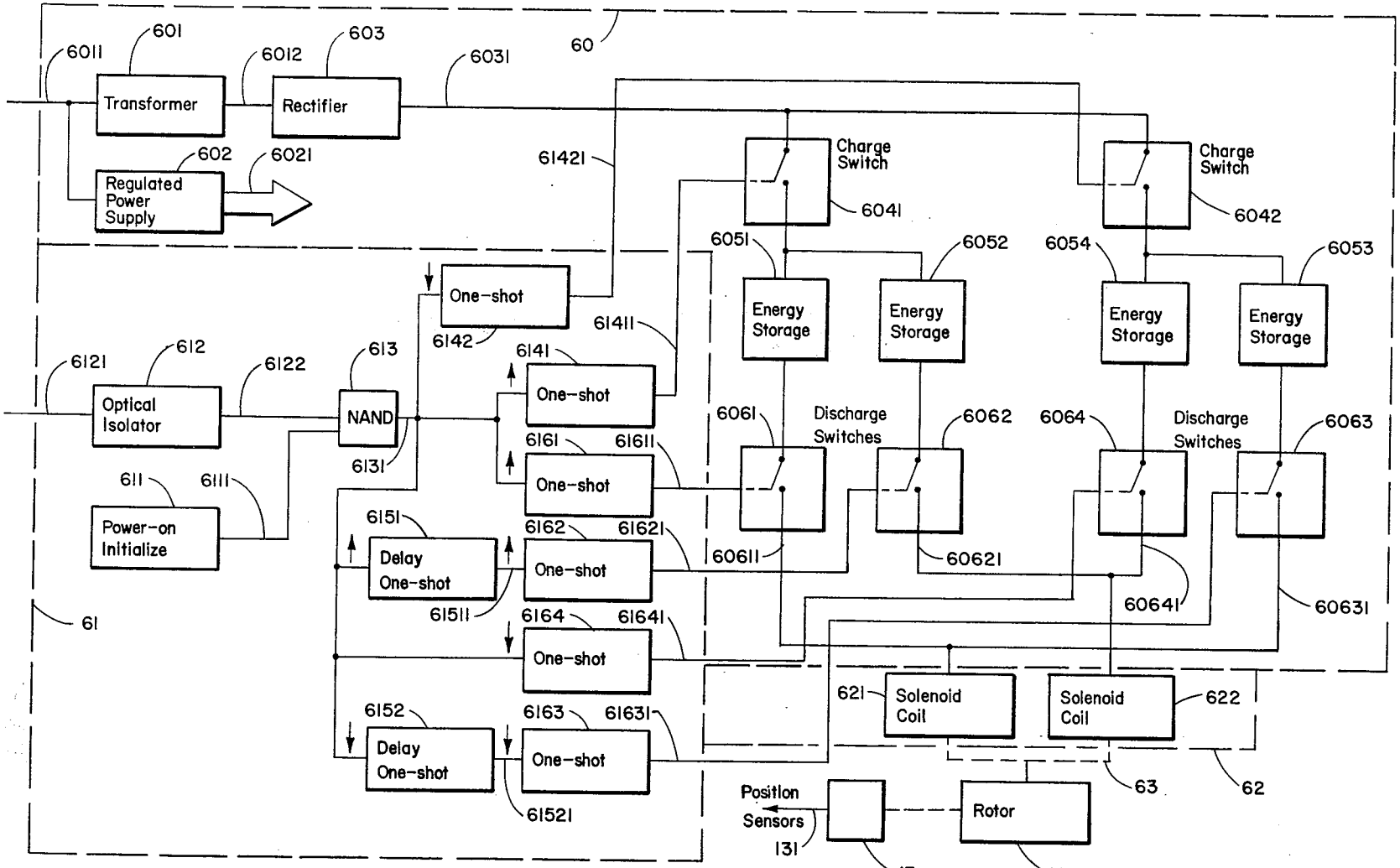
FIG. 6 is a block flow diagram of the applicable electronic circuits required to operate the waveguide switch.

Referring to FIG. 6, this illustrates a block flow diagram of the electronic circuits required to actuate the waveguide switch. This is composed of a power supply circuit 60, a control circuit 61, and a motor circuit 62.

AC power 6011 is input to a transformer 601 and a regulated power supply 602 on input line 6011. Regulated power supply 602 supplies a DC voltage 6021 to the various components of the electronic circuits. A rectifier 603 takes a transformed AC voltage 6012 from transformer 601 and rectifies it to a full wave rectified voltage 6031. Rectified voltage 6031 is supplied to charge switches 6041 and 6042.

The following description applies to the components under charge switch 6041. The operation of the components under 6042 are identical except occurring at a different time.

Charge switch 6041 is in a normally closed position and allows rectified voltage 6031 to charge energy storage devices 6051 and 6052. Discharge switches 6061 and 6062 are normally in the open position thus blocking the discharge of energy storage devices 6061 and 6062. Upon receiving desired signals, discharge switch 6061 will close and charge switch 6041 will open almost simultaneously. This allows the energy stored in energy storage device 6051 to discharge through solenoid coil 621. The discharge of energy storage devices 6052, 6054, and 6053 is similar to that of 6051 excepting the times of discharge.

Figure 7:
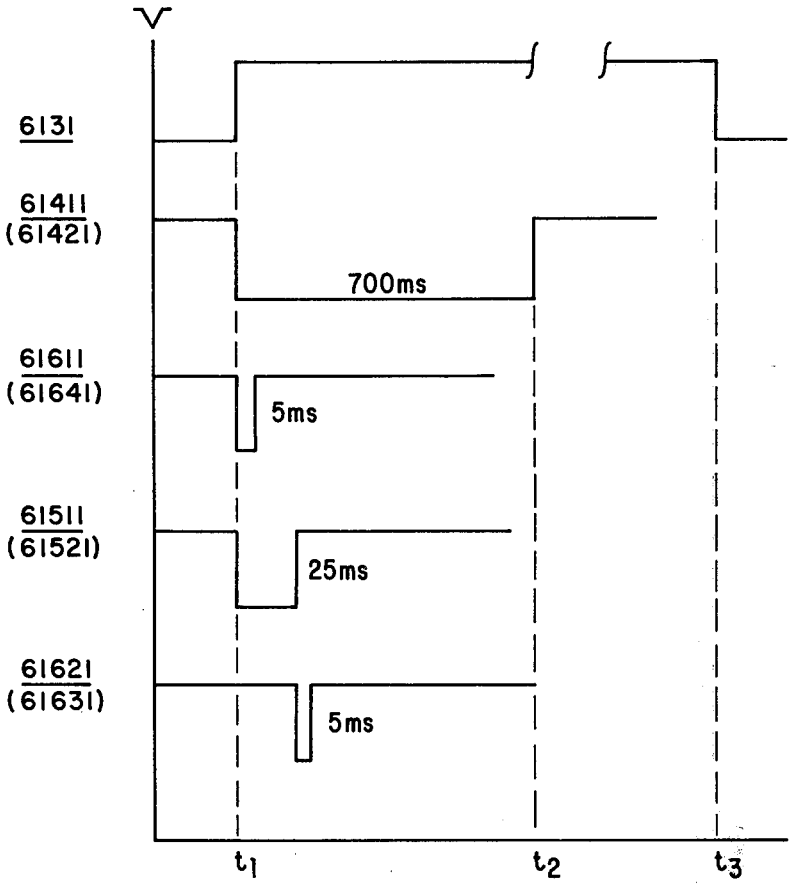
FIG. 7 is a timing sequence diagram showing the output of designated blocks of FIG. 6 upon a switching command.

The opening and closing of charge switches 6041 and 6042 and discharge switches 6061, 6062, 6063, and 6064 is controlled by control circuit 61 of FIG. 6. Control circuit 61 is composed of an optical isolator 612, a power-on initializer 611, a NAND gate 613, and various one-shot flip-flops. Upon power application, power-on initializer 611 outputs an initializing signal 6111. In this embodiment, the initializing signal 6111 is output approximately 5 seconds after power-on. Initializing signal 6111 is a low to high state signal which is applied to NAND gate 613. A switching command signal 6121 is applied to optical isolator 612. Switching command signal 6121 is a signal which goes from a low state to a high state and eventually changes from the high state back to the low state. The initial change in state is called the leading edge; the subsequent change in state is called the trailing edge. Optical isolator 612 inverts switching command signal 6121. NAND gate 613 upon receipt of initializing signal 6111 and an inverted switching command signal 6122 outputs a modified switching command signal 6131 as illustrated in FIG. 7.

The arrows located on the input sides of the one-shot flip-flops indicate whether or not the one-shot will be activated upon receiving a leading edge or a trailing edge signal. If the arrow is pointed down, only a trailing edge signal activates the one-shot. If the arrow is pointed up, a leading edge signal activates the one-shot.

The following description describes, in particular, the control signals necessary to operate the components under charge switch 6041. Similar operations for the components under charge switch 6042 occur at a different time and will be enclosed in parenthesis where appropriate.

Upon receiving the leading edge of modified switching command signal 6122, NAND gate 613 outputs a leading edge of modified switching command signal 6131. Referring to FIG. 7, $t_1$ represents the time when the leading edge is output from NAND gate 613 and is received by a charge interrupt one-shot flip-flop 6141, a driving one-shot flip-flop 6161, and a delay one-shot flip-flop 6151. Upon receipt of the leading edge, one-shot 6141 outputs a high to low state charge interrupt signal 61411 (61421) of approximately 700 milliseconds duration. The 700 milliseconds signal is applied to charge switch 6041 and causes the switch to open and stop charging the energy storage device 6051. Upon receipt of the leading edge, one-shot 6161 outputs a 5 millisecond discharge signal 61611 (61641) to discharge switch 6061, causing the switch to close. Upon the closing of discharge switch 6061, the energy stored in energy storage device 6051 discharges a driving current 60611 through solenoid coil 621. The silicon controlled rectifier (SCR) in discharge switch 6061 will conduct until the energy stored is completely discharged, upon which time the silicon controlled rectifier shuts off and the switch will be opened. Upon receiving this pulse of current, solenoid coil 621 causes rotation, for example, in a counter-clockwise direction of drive/brake gear 421 of FIG. 4. The rotation caused by solenoid coil 621 is transferred by a mechanical linkage 63 to rotor 10, thus rotor 10 is rotating counter-clockwise.

Upon receiving the leading edge of modified switching command signal 6131, delay one-shot 6151 outputs a leading edge delayed signal 61511 (61521) approximately 25 milliseconds after input of the leading edge. Upon receipt of the leading edge delayed signal 61511 by a braking one-shot 6162 (6163), a 5 milliseconds braking signal 61621 (61631) is output to discharge switch 6062. Thus, discharge switch 6062 allows a braking current 60621 to be conducted to the other solenoid coil 622. Since the solenoid coils are oppositely torquing, but rotating in the same direction through mechanical linkage 63, braking current 60621 through solenoid coil 622 counters the rotation caused by solenoid coil 621. The braking current occurs approximately 20 milliseconds after the actuating driving current. At $t_2$, charge switch 6041 closes and continues charging.

The trailing edge of modified switching command signal 6131 occurs at time $t_3$ as shown in FIG. 7, the trailing edge will activate a charge interrupt one-shot flip-flop 6142, a driving one-shot 6164, and a delay one-shot flip-flop 6152. The sequence of pulses emitted by the trailing edge one-shots is identical to the sequence of pulses emitted by the leading edge one-shots as illustrated in FIG. 7. Referring to FIG. 7, the numbers enclosed in parentheses are the signals for the trailing edge circuits. The sequence of signals emitted from the trailing edge components would begin at time $t_3$. The trailing edge signals are applied to charge switch 6042, discharge switches 6064 and 6063. In operation these trailing edge pulses cause the same identical sequence of events on the charge switch and discharge switches as would occur on the leading edge pulses. A driving current 60641 is released by discharge switch 6064. This current causes solenoid coil 622 to torque in a direction opposite to that of solenoid coil 621. Approximately 20 milliseconds after the release of driving current 60641, a braking current 60631 is released by discharge switch 6063. Upon receiving a pulse from braking one-shot 6163 braking current 60631 is applied to solenoid coil 621. This braking current is applied to solenoid coil 621 before it has reached the end of its rotational movement. Since solenoid coil 621 and solenoid coil 622 cause opposite rotational movement of mechanical linkage 63, braking current 60631 creates a torque in solenoid coil 621 opposite to driving current 60641 in solenoid coil 622. This in effect causes mechanical linkage 63 to come to rest without a bounce at the end of its rotational movement.

Thus, the above description taken together with the following claims constitute a disclosure such as to enable a person skilled in mechanical and electronic arts having the benefit of the teachings herein to make and use the invention described herein. Further, the invention described herein constitutes an unobvious advance to such a person not having the benefit of this disclosure.

What is claimed is:

1. A waveguide switch for selectively diverting electromagnetic energy among a plurality of connected waveguides in response to a switching command comprising:

a rotor housing having a plurality of waveguide ports connected to waveguides and a cylindrical void communicating to the ports;

a rotor rotatably mounted within said cylindrical void for diverting electromagnetic energy among the ports, having waveguide bends therein which are selectively aligned with the ports in said rotor housing;

biasing means for selectively rotating said rotor, said biasing means including, a Geneva wheel connected to said rotor, a driving guide engaged by said Geneva wheel for providing a driving engagement therewith, first and second electromechanical transducers mechanically coupled to said driving guide for providing torque thereto to selectively rotate or break the rotation for said rotor;

electrical power means for supplying driving and braking electrical currents to said first and second electromechanical transducers of said biasing means; and control circuit means responsive to the switching command, for providing signals to said electrical power means for determining the sequence of driving and braking electrical currents applied to said first and second electromechanical transducers, whereby rotation of said rotor is effected without bounce.

2. A waveguide switch as in claim 1 wherein said rotor housing has an input port, a primary output port, and a secondary output port, said ports located in a common plane, said ports having a rectangular shape with perpendicular intersecting walls, said ports having longitudinal axes perpendicular to the axis of said cylindrical void and located on radii thereof, said output ports communicating with the cylindrical void and diametrically opposing each other, the input port communicating with the cylindrical void and located on the perpendicular between the output ports.

3. A waveguide switch as in claim 2 wherein said rotor is cylindrically shaped with perpendicular ends having a cylindrical shaft fixedly attached to a perpendicular end and centered thereon for connection to said biasing means, said rotor having a diameter slightly less than the cylindrical void in said rotor housing so as to minimize leakage, said rotor having two waveguide channels therein, the rotor waveguide bends having an annular shape so as to minimize VSWR and maximize bandwidth, one bend diametrically opposed to the other, one rotor waveguide openings being closely coincident to the input and primary output ports and the other rotor waveguide openings being closely coincident to the input and secondary output ports upon a 90° counter-clockwise rotation of said rotor.

4. A waveguide switch as in claim 1, wherein said first and second electromechanical transducers comprise rotary solenoids.

5. A waveguide switch as in claim 4, wherein said rotary solenoids comprises a pair of unidirectional rotary solenoids.

6. A waveguide switch as in claim 5, wherein said pair of unidirectional rotary solenoids torque in a direction opposite to each other, fixedly attached to said housing, output shafts rotatably secured within bearing means in said housing, the output shafts located in substantially the same plane and parallel to one another, having identical drive gears fixedly attached to the output shafts, the drive gears in driving engagement with one driven gear having a gear ratio of one-to-one to the drive gears, rotatably mounted between said drive gears, the driven gear axis located substantially in the same plane as the output shafts and parallel therewith, the gears engagingly meshed so that said rotary solenoids rotate in the same direction.

7. A waveguide switch as in claim 4 wherein said geneva wheel is fixedly attached to said rotor having two detent stops on its circumference so that its rotation therebetween is 90°, having one detent mechanism to interact with the detent stops, having a guide channel perpendicular to said rotor and located on a side opposite from said rotor and a geneva drive comprising a drive shaft upon which a driven gear is fixedly attached, a lever arm fixedly attached to said drive shaft, having a guide pin fixedly attached to said lever arm, having a guide bearing fixedly attached to said guide pin so that it translates within said guide channel upon rotation of said drive shaft and causes said geneva wheel to rotate a predetermined angle of rotation, closely to 90°.

8. A waveguide switch as in claim 1 wherein said housing comprises a main housing fixedly attached to said rotor housing and having bearing means for rotatably supporting said rotor and said biasing means, a mounting plate means fixedly attached to the main housing for fixedly holding bearing means and for rotatably supporting said biasing means, and a cover means the main housing.

9. A waveguide switch of claim 1 wherein said electrical power means comprises a transformer to adjust an input voltage, a regulated power supply to output a DC voltage to other electrical components, a rectifier to convert the adjusted AC voltage to a rectified voltage for charging an energy storage device, charging switches used to interrupt the rectified voltage in the charging process upon receiving a signal, energy storage devices for storing a charge, discharge switches controlled by signals output from said controlling means so that the energy storage devices release their energy upon command, and solenoid coils for receiving a driving and a braking current in a predetermined manner such that a driving torque is cancelled by a braking torque so mechanical linkage causes said rotor to rotate 90° without bounce.

10. A waveguide switch of claim 1 wherein said control means comprises an optical isolator for conditioning the switching command signal and outputting an inverted switching command signal, a power-on initializing circuit, a NAND gate circuit which receives the inverted switching command signal from the optical isolator and the initializing signal and outputs a modified switching command signal which has a leading and trailing edge, two charge interrupt one-shot flip-flops, one of which actuates upon the leading edge and the other on the trailing edge, two driving one-shot flip-flops, one of which actuates on the leading edge and the other on the trailing edge, outputting a signal to discharge switches to release a driving current to one solenoid coil upon the leading edge and the other coil upon the trailing edge, two delay one-shot flip-flops, one actuating on the leading edge and the other on the trailing edge, outputting a delay signal after a fixed period of time, two braking one-shot flip-flops for receiving the delay signals from the two delay one-shot flip-flops, one actuating on the leading edge and the other on the trailing edge, outputting a signal to the discharge switches to release a braking current on either the leading edge or trailing edge after a preset time after the driving current has been released.

* * * * *